United States Patent [19]

Crook

[11] 4,228,743

[45] Oct. 21, 1980

[54] BEHIND DOOR SHELF ASSEMBLY

[76] Inventor: Douglas H. Crook, 5849 32nd Ave. North, St. Petersburg, Fla. 33710

[21] Appl. No.: 882,380

[22] Filed: Mar. 1, 1978

[51] Int. Cl.[2] ..... A47B 4/04

[52] U.S. Cl. ..... 108/31; 312/264; 108/91

[58] Field of Search ..... 108/31, 111, 91; 312/263, 264; 211/88, 90, 186, 188, 189, 194

[56] References Cited

U.S. PATENT DOCUMENTS

| | | | |
|---|---|---|---|
| 460,748 | 10/1891 | Hartmann | 108/91 |
| 650,699 | 5/1900 | Williams | 312/264 |
| 873,496 | 12/1907 | Bryant | 312/264 X |
| 2,800,380 | 7/1957 | Baker | 211/88 X |
| 3,207,098 | 9/1965 | Alpert | 108/91 X |
| 3,229,029 | 1/1966 | Weiss | 312/263 X |

*Primary Examiner*—Ramon S. Britts
*Assistant Examiner*—Peter A. Aschenbrenner
*Attorney, Agent, or Firm*—Walter J. Monacelli

[57] ABSTRACT

The shelf assembly described herein comprises a shelf arrangement designed for assembly by sliding in a limited manner doweled or tubed component parts into interlocking arrangement from the rear of the assembly. This has the advantages of a locked arrangement once the assembly is fastened to the back of a door and allows for greater structural strength and improved appearance of the front of the assembly.

7 Claims, 10 Drawing Figures

BEHIND DOOR SHELF ASSEMBLY

BACKGROUND OF THE INVENTION

1. Field of the Invention

This invention relates to a shelf assembly particularly adapted to be attached to the back of a door. More specifically, it relates to the interlocking of a number of component parts whereby the parts are assembled by sliding doweled and tubed portions into interlocking positions from the rear of the assembly. Still more specifically, it relates to a shelf assembly of improved appearance and structural strength by virtue of this rear assembly.

2. State of the Prior Art

Various types of furniture, cabinets, etc. have been shown to be constructed by the interlocking of component parts. For example, U.S. Pat. No. 3,435,575 shows in FIGS. 26 and 27 the locking of two components for furniture assembly comprising a partially cylindrically shaped component 28 inserted into another larger partially cylindrically shaped component 26.

Also, U.S. Pat. No. 3,791,091 shows modular construction in which a tongue attached to one module is slid into interlocking relationship with a grooved component attached to another module. U.S. Pat. No. 3,747,885 shows a similar type of modular furniture construction. U.S. Pat. No. 3,288,301 shows a printed circuit card frame in which component parts of the frame are interlocked to each other by sliding a male attachment on one part into a similarly shaped opening into an adjacent component. U.S. Pat. No. 3,674,328 shows a slipjointed knockdown cabinet assembled by sliding a tongue on one component into an interlocking groove in another component.

However, none of these prior art structures disclose a shelving assembly in which the components are assembled from the rear and locked in a manner to prevent the component parts from sliding frontwards from the assembly. Moreover, where there is to be permanent locking into position, the prior art has effected this by gluing the component parts to each other or by driving a screw through two adjacent parts.

SUMMARY OF THE INVENTION

In accordance with the present invention, it has been found that the appearance and structural strength of assembled shelving may be improved by a new design in which component parts are interlocked by a special dowel and tube arrangement in which the dowels are slid into the appropriate tubes from the rear of the assembly. Subsequently, when the assembly is fastened to the back of a door, or to a wall or other appropriate vertical area, the component parts are locked into position.

The shelving assembly comprises a plurality of side panels, an equal number on each of the two sides of the assembly. The top and bottom side panels have one dowel element or tube element, while the intermediate side panels have two such elements, either two of the same or one of each kind. These elements are arranged so that the adjacent edges of adjacent side panels have the opposite type of element so that a doweled element will fit into a tube element. Preferably three side panels are used on each side of each shelf assembly with the middle panel having a tube element at both linear extremities and the top and bottom elements each have one doweled element.

Each of the side panels also have a slot running perpendicular to the length of the panel and extending from the rear edge through at least half and no more than about 0.9, preferably no more than 0.75 of the width of the side panel. This means that the front of the shelf assembly has greater structural strength.

Each of the side panels also has a flange affixed perpendicularly and extending outwardly from the panel and adapted by openings for screws or otherwise to be attached to a door or a wall area. These flanges also have a opening therein positioned and communicating with the vertical slot described above. This opening is adapted in size, shape and position to receive a doweled element as described below with respect to the individual shelves. The flange is advantageously extended to a position so that its outer surface is flush with the end of a doweled element to which it may be attached and the inner surface is advantageously flush or even with the adjacent end of a tube element. In this way the adjacent side panels are aligned with each other and the doweled element is prevented from sliding too far into the tube element. This also means that the assembly of the component parts has to be from the rear and that the assembly is locked into position when the respective panels are fastened to a door or wall area.

The shelving assembly also includes an appropriate number of shelf elements or shelves each comprising a rigid rectangular sheet each having a doweled element at each linear edge adapted to fit through the opening described above in the flanges on the side panels and the ends of the shelves at which the doweled members are attached being of an appropriate thickness to fit into the slots described above as being in the side panels. The width of the sheet or shelf at the ends which fit into the slots are only of sufficient dimension to occupy the full length of each slot.

Each shelf advantageously has a flange extending vertically upwardly from the front edge of the sheet and likewise the rear edge of the sheet may also have a flange extending vertically upward therefrom.

The novel design of this invention may be illustrated by reference to the accompanying drawings in which.

DETAILED DESCRIPTION

Figure 1:
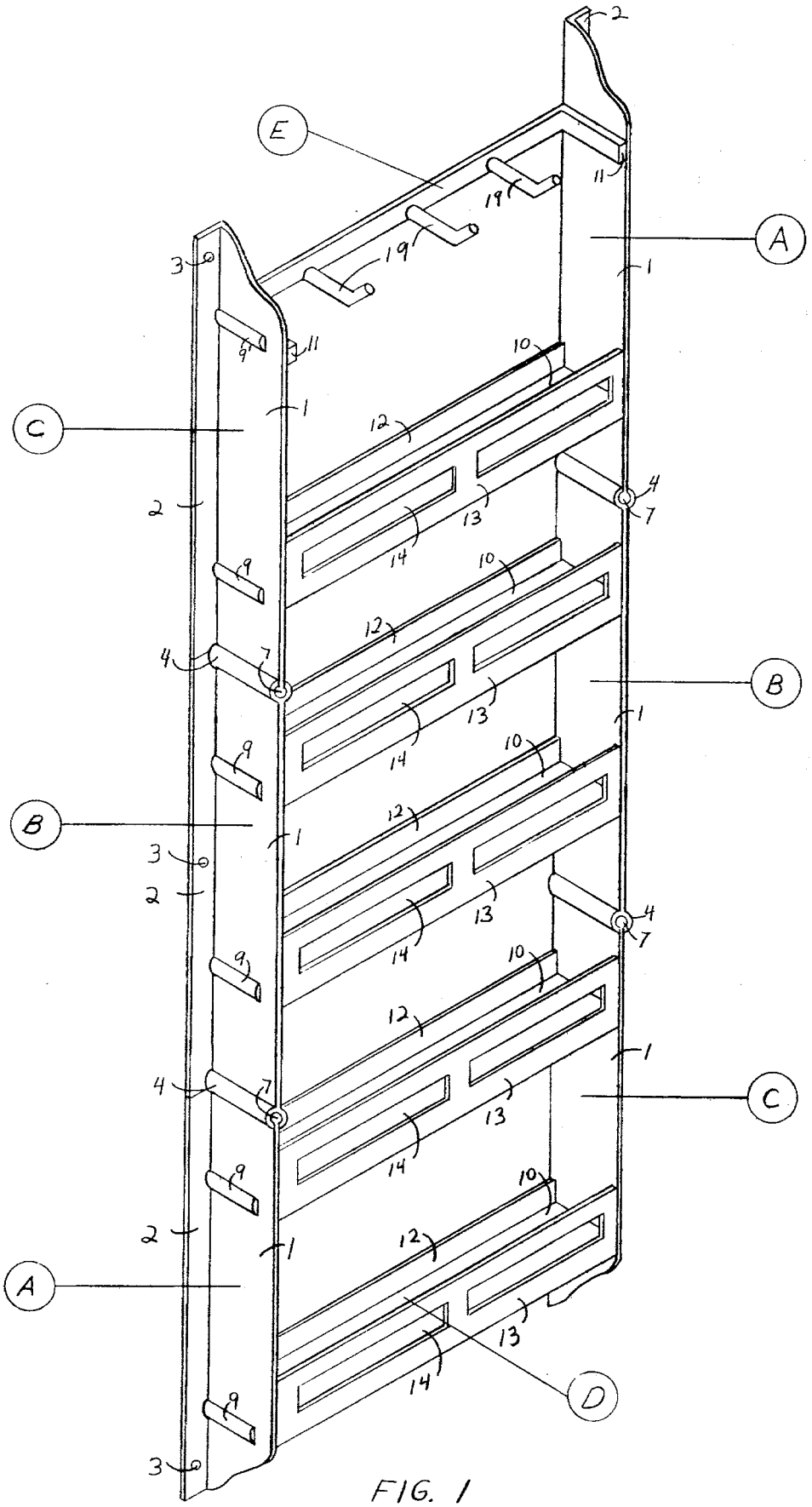
FIG. 1 is a perspective view of the assembled shelving with component parts identified as A, B, C, D and E.
Figure 2:
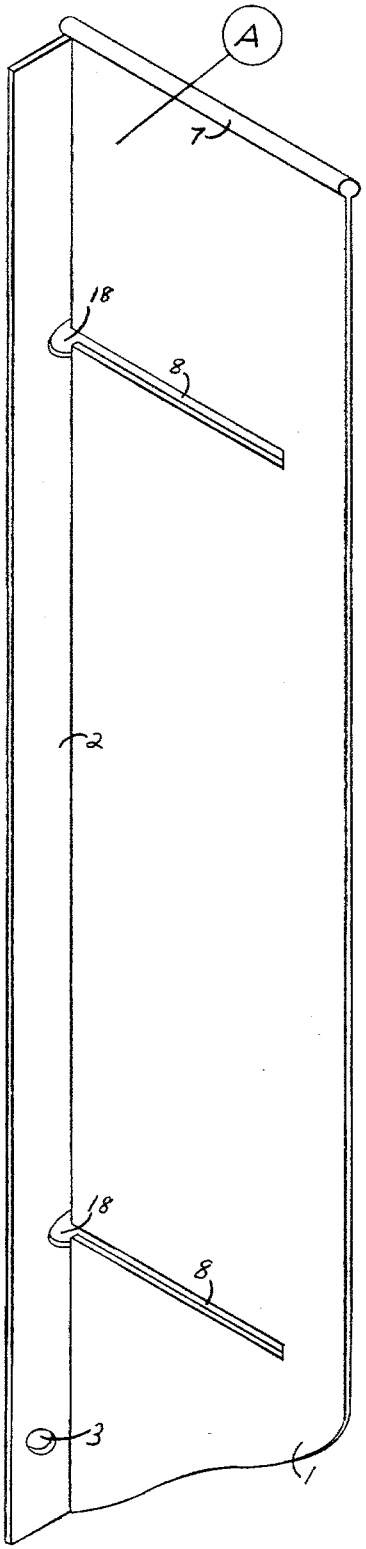
FIG. 2 is a perspective view of Part A.
Figure 3:
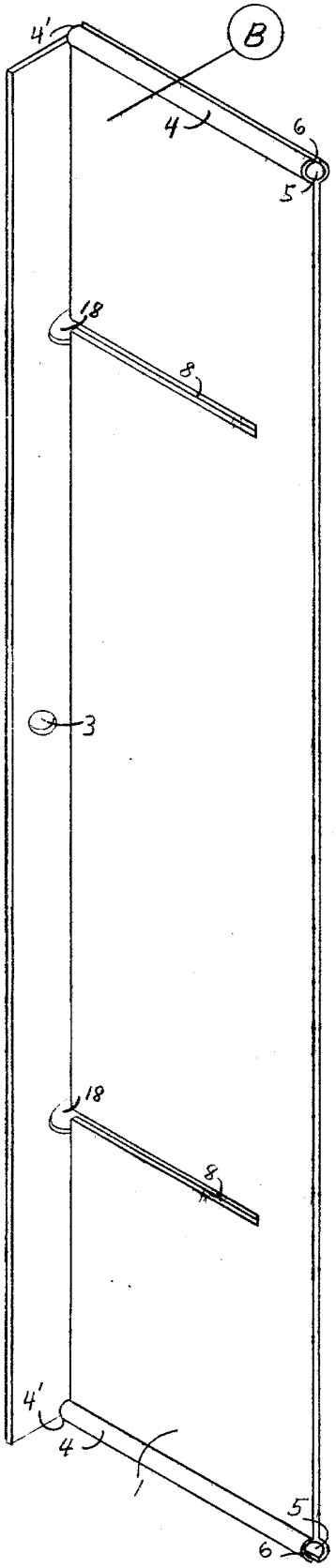
FIG. 3 is a perspective view of Part B.
Figure 4:
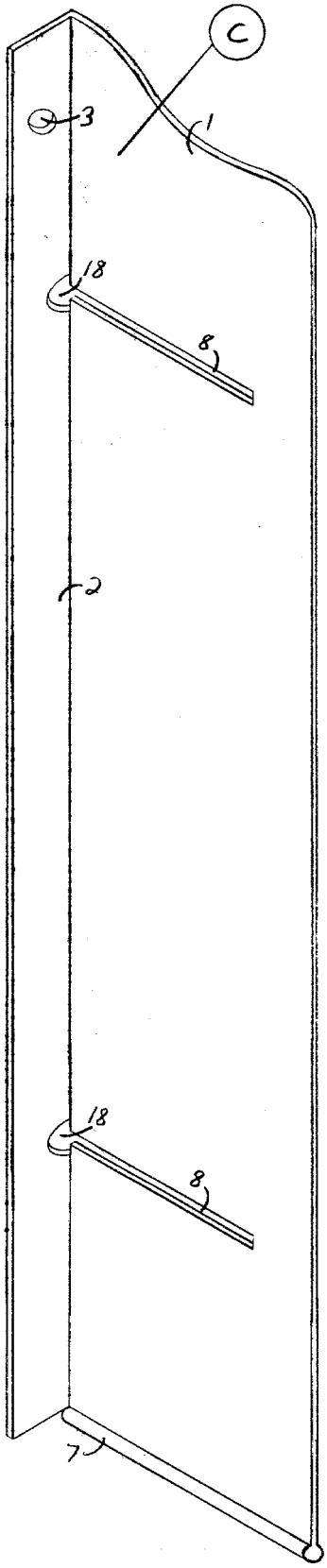
FIG. 4 is a perspective view of Part C.
Figure 5:
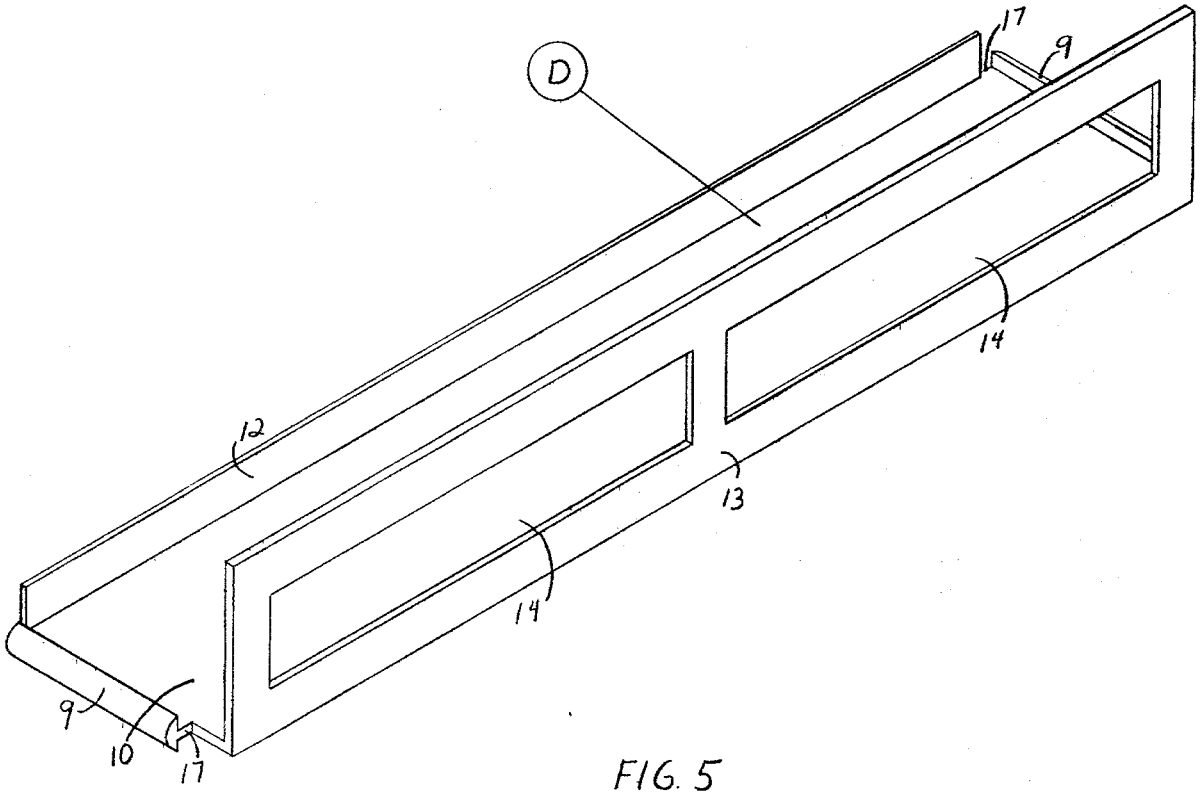
FIG. 5 is a perspective view of Part D.
Figure 9:
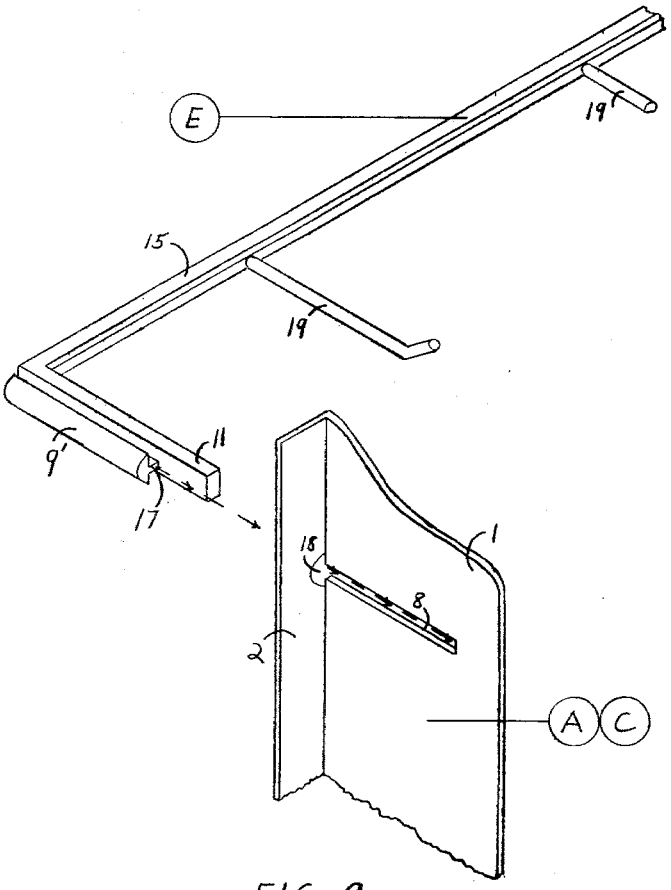
FIG. 9 is a perspective partial view of Parts E and A or C showing the sliding interlocking arrangement of the two parts.
Figure 6:
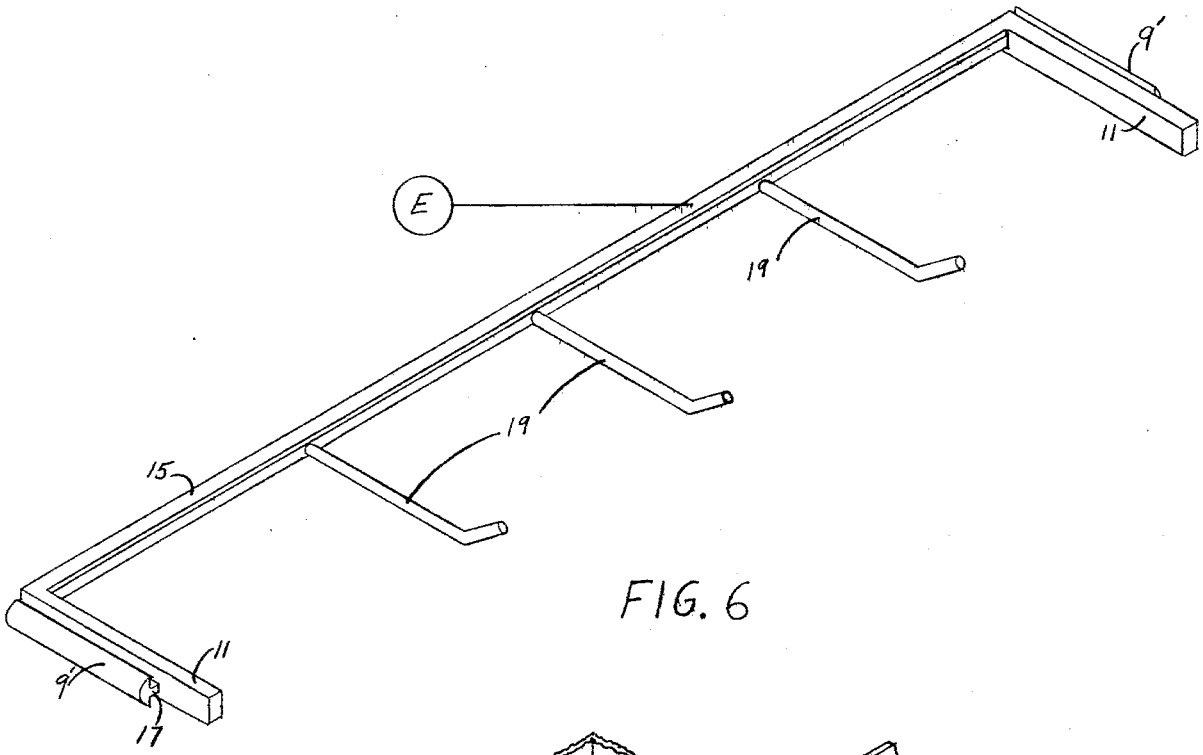
FIG. 6 is a perspective view of Part E.
Figure 10:
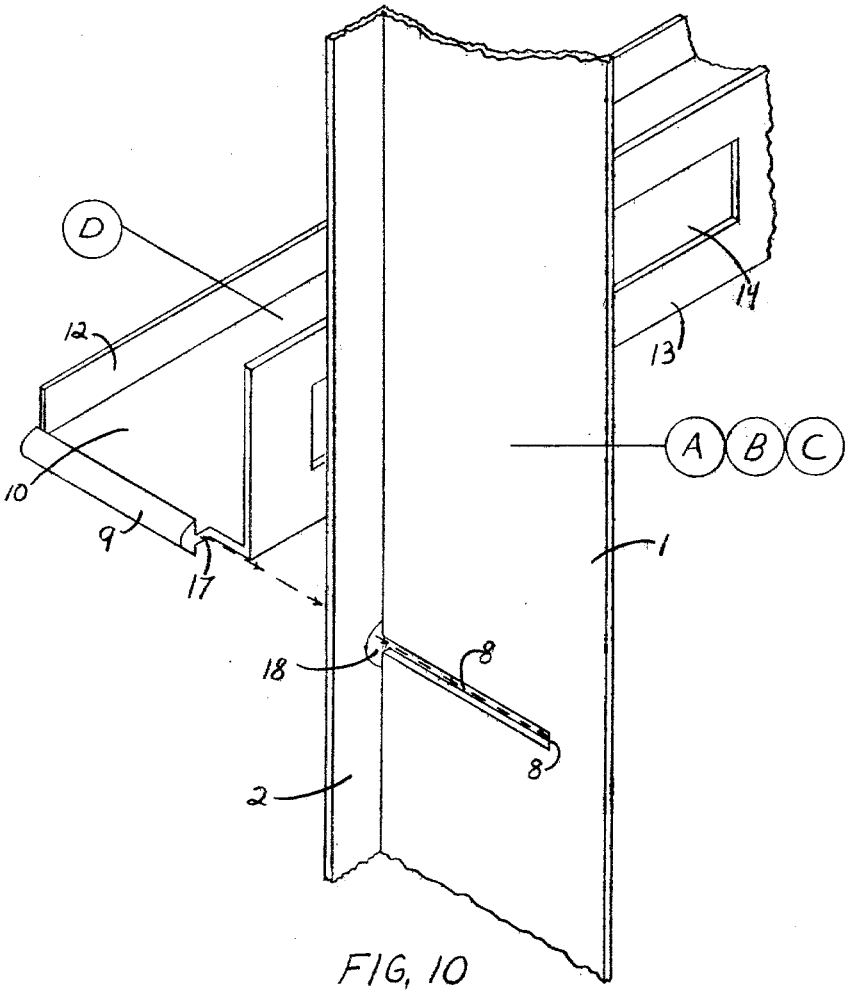
FIG. 10 is another perspective partial view of Parts D and A, B or C, showing the sliding interlocking arrangement of the two parts.
Figure 7:
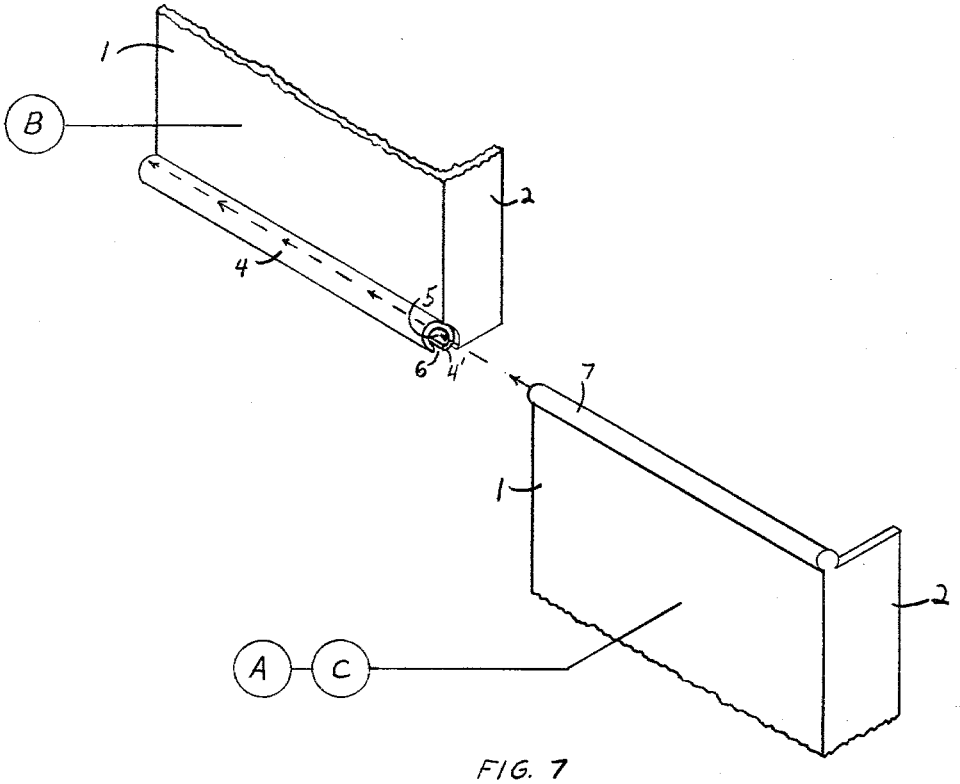
FIG. 7 is a perspective partial back view of Parts A or C and B showing the sliding interlocking arrangement.
Figure 8:
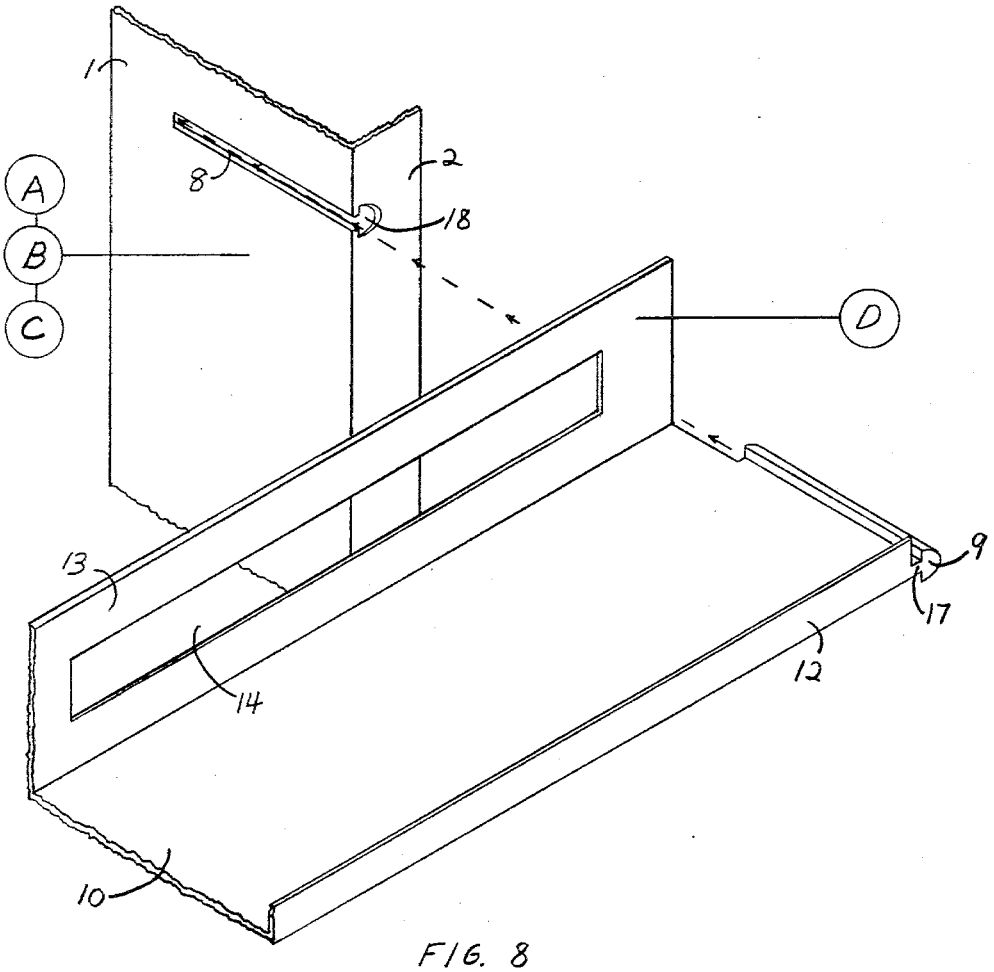
FIG. 8 is a perspective partial view of Parts D and A, B or C, showing the sliding interlocking arrangement of the two parts.

In the figures, side panel 1 has a flange 2 attached thereto or integrally extending therefrom. Flange 2 has at least one opening 3 therein to accommodate a screw or bolt for attachment to a door. Part B has a cylindrically shaped member 4 attached to each linear extremity thereof which embraces opening 5 into which a dowel member 7 attached to one of the linear extremities of A or C is inserted by means of slot 6 and slid into the entire length of opening 5 in member 4. The sliding of dowel member 7 beyond the end of opening 5 is prohibited by the striking of flange 2 against the adjacent jutting edge 4' of member 4. The exterior shape of 4 is preferably cylindrical, but may be square, rectangular or any other convenient or desirable shape. Likewise, the configuration of the opening 5 is preferably cylindrical, but may also be substantially rectangular, triangular, etc., with the exterior shape and size of dowel 7 corresponding to that of the interior of opening 5 so as to provide a snug fit therein.

Parts A, B and C have slots 8 therein running perpendicularly to the length of panel 1 and extending at least one-half, but less than the full width, of the panel 1, preferably no more than 0.9 of the width of the panel. The remaining unslotted portion of A, B and C allows greater structural strength to be maintained in these parts. Slot 8 connects with opening 18 in flange 2. This slot accommodates the entrance of rib 17 while opening 18 accommodates the entrance of dowel 9. Rib 17 connects dowel 9 to platform 10 and may be merely an extension of platform 10. Slot 8 and opening 18 may also accommodate rib 17 and dowel 9' extending from arm 11 of part E. In both cases the dowel attachments 9 and 9' protrude outside of panel 1 pressing against the outer surface thereof thereby locking the shelf securely in position.

The shelf D comprises platform 10 with lip 12 extending vertically from the back edge of platform 10 and frontpiece 13 extending vertically from the front edge of platform 10. Lip 12 and frontpiece 13 may be of any appropriate or desired design. In this case, frontpiece 13 has one or two oblong openings 14 thereon. Rib 17 and dowel 9 (or 9') extend only part way toward the front of platform 10 (or arm 11 of part E) so that it does not reach to the front of side panel 1. This design allows for greater strength in the front of the assembly.

Peg shelf or part E comprises back support 15 and arms 11 extending perpendicularly and horizontally forward therefrom. Arms 11 have the dowel attachments 9' which slide through opening 18 in top parts A and C. The dowel attachments 9' are connected to the outside edges of arms 11 by rib 17 which slides into slots 8 in A and C respectively. Pegs 19 extend forward from back support 15 and may be used to support small sundry items with peg hole packaging theme or other appropriate articles. If desired, peg shelf E may be replaced by another shelf D.

The modification shown in FIG. 1 has five shelves of the D type and one peg shelf E. The number of shelves may be increased or decreased as desired by increasing or decreasing the lengths of parts A, B and C and adjusting the position of slots 8 and openings 18 to accommodate the desired number of shelves and the desired amount of space between shelves. The width of the shelves may also be modified by selecting an appropriate width for part D. The depth of shelf D may also be modified as desired with appropriate corresponding changes in the widths of parts A, B and C and in the lengths of slots 8 and ribs 17. However, where the shelf assembly is to be used behind a door, the shelf depth is generally about 3 inches since present doorstops accommodate about this space between the door and an adjacent wall. If a greater depth is desired it may be desirable to use a longer doorstop to accommodate having such deeper shelves without the danger of having the shelves hit the adjacent wall when the door is swung open. Moreover, while the modification shown in the drawings has three side segments on each side of the assembly, it is also possible to modify this number to two or four segments with appropriate modifications in the interlocking arrangements.

Furthermore, while part B is shown with similar open members 4 at each extremity thereof into which the dowel attachments of parts A and C may be inserted, it is also contemplated that B may have one open member 4 at one extremity and a dowel member 7 at the other extremity with A and C equipped with the appropriate opposite member to be joined with the adjacent portion of B.

The components of this invention may be made of any suitable material such as metal, plastic, etc. Preferably plastic is used since it may easily be molded in the desired shapes and with appropriate slots and openings. If desired, each component may be made as an integral piece or several pieces may be glued or otherwise fastened together.

While certain features of this invention have been described in detail with respect to various embodiments thereof, it will of course be apparent that other modifications can be made within the spirit and scope of this invention and it is not intended to limit the invention to the exact details shown above except insofar as they are defined in the following claims:

The invention claimed is:

1. A shelving assembly comprising:

(a) a plurality of side panels of rectangular shape having attached at their linear ends either element of a dowel-tube arrangement, the outer configuration of said dowel conforming in size and shape to fit closely inside the opening in said tube, said side panels comprising two sets of a top panel, a bottom panel and at least one intermediate panel, the top and bottom side panels of said assembly having only one of said elements and the intermediate said panels having two of said elements so arranged as to be fitted to and interlocked with its opposite element in the adjacent side panel, said side panel also having a slit running perpendicular to the length of said side panel and extending from the rear edge of said side panel to at least half but not more than 0.9 of the width of said panel, and each said side panel having a flange affixed to the back linear edge of said side panel and extending perpendicularly therefrom and adapted to be fastened to a vertical door or wall area, said flange having an opening positioned at and communicating with the said slot extending part way through the width of said side panel, said opening being enlarged with respect to the width of said slot and adapted to receive a dowel element, and said flange being of appropriate length and positioned close to the adjacent end of any said doweled element attached to the corresponding side panel that it would extend over a portion of the tube element thereby preventing the dowel of the doweled element from sliding any further into the opening of said tube element and also thereby requiring the doweled member to be introduced from the opposite end into the opening of the tube member; and (b) a plurality of shelf elements comprising a rigid rectangular sheet or platform having a doweled element attached along the edge of each of the linear ends thereof, said doweled element being adapted to fit through the said opening in said flange and the end of said sheet to which said doweled element is attached being of an appropriate thickness to fit into one of said slots in said side panels, the width of the said rectangular sheet at the edge to which said doweled element is attached being only of appropriate dimension to extend the full length of the slot into which it is inserted.

2. The shelving assembly of claim 1 in which each said shelf element has a flange extending vertically upward from the front linear edge of said rectangular sheet.

3. The shelving assembly of claim 2 in which each said shelf element also has a flange extending vertically upward from the back linear edge of said rectangular sheet.

4. The shelving assembly of claim 1 in which each said shelf element has a flange extending vertically upward from the back linear edge of said rectangular sheet.

5. The shelving assembly of claim 1 in which each said dowel element is cylindrical in shape except for the portion attached to said side panel and the opening in each said tube element corresponds in size and cylindrical shape to accommodate a snug fit of the dowel element therein.

6. The shelving assembly of claim 1 in which said tube element of said side panel extends only to the inside surface of said flange attached to said side panel whereby the flanges on said adjacent side panels are thereby aligned.

7. The shelving assembly of claim 1 in which said assembly includes at the top thereof a back support member having two side arms extending perpendicularly forward therefrom and having attached to each of said side arms a doweled member in a manner similar to that described for said shelf elements, and said back support member having a plurality of pegs extending forward therefrom.

* * * * *